US006109191A

United States Patent [19]

Schwörer

[11] Patent Number: 6,109,191

[45] Date of Patent: Aug. 29, 2000

[54] FORMWORK TABLE ARRANGEMENT ESPECIALLY FOR CEILINGS AND INTERMEDIATE FLOORS

[75] Inventor: Artur Schwörer, Senden, Germany

[73] Assignee: Peri GmbH, Weissenhorn, Germany

[21] Appl. No.: 09/277,352

[22] Filed: Mar. 26, 1999

[30] Foreign Application Priority Data

Mar. 27, 1998 [DE] Germany ..... 198 13 789

[51] Int. Cl.[7] ..... A47B 3/00

[52] U.S. Cl. ..... 108/115; 108/132

[58] Field of Search ..... 108/157.12, 115, 108/116, 121, 129, 132, 158.13, 159.11, 42, 1, 6, 9, 10

[56] References Cited

U.S. PATENT DOCUMENTS

| | | | |
|---|---|---|---|
| 3,082,712 | 3/1963 | Trautmann et al. | 108/158.13 X |
| 3,152,709 | 10/1964 | Fowler | 108/129 X |
| 5,259,305 | 11/1993 | Korb | 108/132 X |
| 5,325,794 | 7/1994 | Hontani | 108/115 X |
| 5,542,639 | 8/1996 | Wixey et al. | 108/132 X |

FOREIGN PATENT DOCUMENTS

| | | | |
|---|---|---|---|
| 1442480 | 5/1966 | France | 108/129 |
| 2648281 | 4/1978 | Germany . | |
| 2824106 | 12/1978 | Germany . | |
| 2900305 | 7/1980 | Germany . | |
| 2929318 | 2/1981 | Germany . | |
| 3147382A1 | 6/1983 | Germany . | |
| 2929318C2 | 12/1987 | Germany . | |
| 3843336C1 | 2/1990 | Germany . | |
| 19605824C1 | 10/1997 | Germany . | |
| 2266114 | 10/1993 | United Kingdom . | |

*Primary Examiner*—Jose V. Chen
*Attorney, Agent, or Firm*—Townsend and Townsend and Crew LLP

[57] ABSTRACT

A formwork table arrangement having a formwork table (13) and a plurality of supports (11) each of which is downwardly pivotably and removably mounted via a transition support member (12), which can be releasably secured to a head end of the respective support, to a counter-support member (14) that is releasably attached to a lower side of the formwork table. Hooks and hook holders (17, 18) are provided at the transition support member (12) and at the counter-support member (14) which permit suspension of the transition support member (12) from the counter-support member (14). A latching arrangement (24, 25, 28) enables the latching of the transition support member (12) to the counter-support member (14) when tilted into the normally upright working position.

27 Claims, 5 Drawing Sheets

FORMWORK TABLE ARRANGEMENT ESPECIALLY FOR CEILINGS AND INTERMEDIATE FLOORS

FIELD OF THE INVENTION

The invention relates to a formwork table arrangement comprising a formwork table and a plurality of supports each of which is downwardly pivotably and removably mounted via a transition support member, which is preferably releasably secured to a head end of the respective support, to a counter-support member, which is preferably releasably secured to a lower side of the formwork table.

PRIOR ART

Formwork table arrangements of the kind described above are known in various embodiments (DE-OS-2648281; DE-OS 2900305; DE 3843336 C1). The essential problem with such formwork table arrangements lies in the fact that the supports must be connected to the support framework stiffening the formwork table in a manner which is relatively stiff in bending. However, after the dismantling of the support from the formwork table, a situation should be achieved in which, so far as possible, no components project downwardly beyond the formwork table. This makes it possible to achieve a low stack height when a plurality of formwork tables are stacked on top of one another during transport on trucks or during storage.

OBJECT OF THE INVENTION

The object of the present invention is to provide a formwork table arrangement of the initially named kind in which the downwardly swung supports which carry the formwork table are connected to the formwork table or its support framework in a manner which is particularly stiff in bending, with it simultaneously being ensured, when the supports are removed from the formwork table, that any components which are provided for the connection to the supports project at most by a minimal amount below the lower boundary of the formwork table or of the support arrangement stiffening it.

BRIEF DESCRIPTION OF THE INVENTION

In order to satisfy this object, a formwork table of the initially named kind is provided in which engaging means are provided at the transition support member and at the counter-support member by means of which the transition support member can be engaged with or suspended from the counter-support member, in particular pivotably engaged or suspended from the counter-support member, preferably in a state tilted relative to the vertical, and in which latching means are provided by means of which the transition support member tilted into the working position can be latched to the counter-support member. It is particularly preferred when the support members are respectively terminated at the top and at the bottom by support plates. Thus, the transition support member and the counter-support member each have a preferably generally rectangular support plate which extends at least substantially parallel to the formwork table in the working position, with the support plates contacting one another in the working position and being preferably pressed against one another by the engaging or latching means.

In this manner it is possible to engage the supports, which are connected to the transition support members, into the counter-support members, which are connected firmly to the formwork table, while the supports are in an inclined position. Thereafter, the supports can be pivoted without problem relative to the counter-support members into the vertical position and finally latched firmly to the counter-support members. Since all the components of the counter-support members can be accommodated within the support framework of the formwork table, and since only the lowermost part of the counter-support member formed by a support plate projects downwardly beneath the support framework, in particular beneath the reinforcing or truss beams of the formwork table, the thickness of the formwork table is only minimally increased by the counter-support members of the invention, as secured to the formwork table. Accordingly, the stack height of a plurality of formwork tables stored one above the other is only increased in negligible manner relative to formwork tables without counter-support members.

Since the support plates can be connected as rigidly as desired to the support framework of the formwork table and to the upper end of the components which act at the upper end of the supports, via correspondingly stable intermediate components, the bending stiffness which is achieved by the mutual engagement and latching of the support plates is extremely high. Despite the minimal stack height of the formwork table of the invention, both simple engagement and also pivoting of the supports is possible without problem and an ideal bending stiffness is ensured in the latched state. The design of the invention also makes it possible to arrange two truss beams closely alongside one another in each case and to associate a single counter-support member with these double beams.

In accordance with the invention the transition support member is preferably primarily firmly connected to the upper region of the supports, so that the generally present head plate of the supports at most only secondarily participates in the mounting of the supports in a manner stiff in bending.

The possibility of engaging and latching the supports to the counter-support members from below means the installation and dismantling of the supports at the formwork table can be achieved without the fitter having to climb up to the top of the supports.

The provision of the actuating lever has the advantage that the delatching can be carried out from below by means of a bar or the like in that the actuating hoop is simply pushed upwardly. On the other hand, the latching can expediently simply take place in such a way that the actuating hoop pivots downwardly as a result of the weight force, and thus brings the latching lever into engagement with the associated support plate.

The hooks are preferably mounted on the upper support plate and the hook holders on the lower support plate, as defined in claim 16.

By providing numerous bores alongside one another in the carrier beams, the counter-support members can be secured at numerous different positions between transverse beams. In just the same way the carrier beams, which form a frame with the attachment brackets, can be mounted at any desired positions between two neighboring transverse beams, so that the counter-support members can practically be mounted at any desired position at the lower side of a formwork table.

The supports normally have head plates at the top and at the bottom. In this case provision should be made that the upper head plates contact the underside of the support plates of the transition support member. In this manner, the head plates participate in a mounting of the supports in a manner which is stiff in bending without being overloaded.

Another embodiment provided that the latching process takes place automatically on pivoting the support out of the tilted engagement position into the working position, If desired the latching levers automatically snap into the latched position.

BRIEF DESCRIPTION THE DRAWINGS

The invention will be described in the following by way of example and with reference to the following drawings:

FIG. 1 is a perspective view of a formwork table arrangement in accordance with the invention seen obliquely from below, FIG. 2 is a perspective enlarged view of a carrier frame in accordance with the invention, FIG. 3 is an enlarged perspective view of a counter-support member in accordance with the invention, FIG. 4 is a similar perspective view of a transition support member in accordance with the invention, FIG. 5 is a perspective view of the assembly of a carrier frame in accordance with the invention, of a counter-support member in accordance with the invention and of a transition support member in accordance with the invention, with the formwork table and the associated supports not being shown for the sake of simplicity, FIG. 6 is a view of the same subject as in FIG. 5 but essentially from the opposite direction and in a somewhat different perspective, and FIG. 7 is a schematic side view of a section of a formwork table arrangement in accordance with the invention in the working position showing the essential components.

DESCRIPTION OF THE PREFERRED EMBODIMENTS

Figure 1:
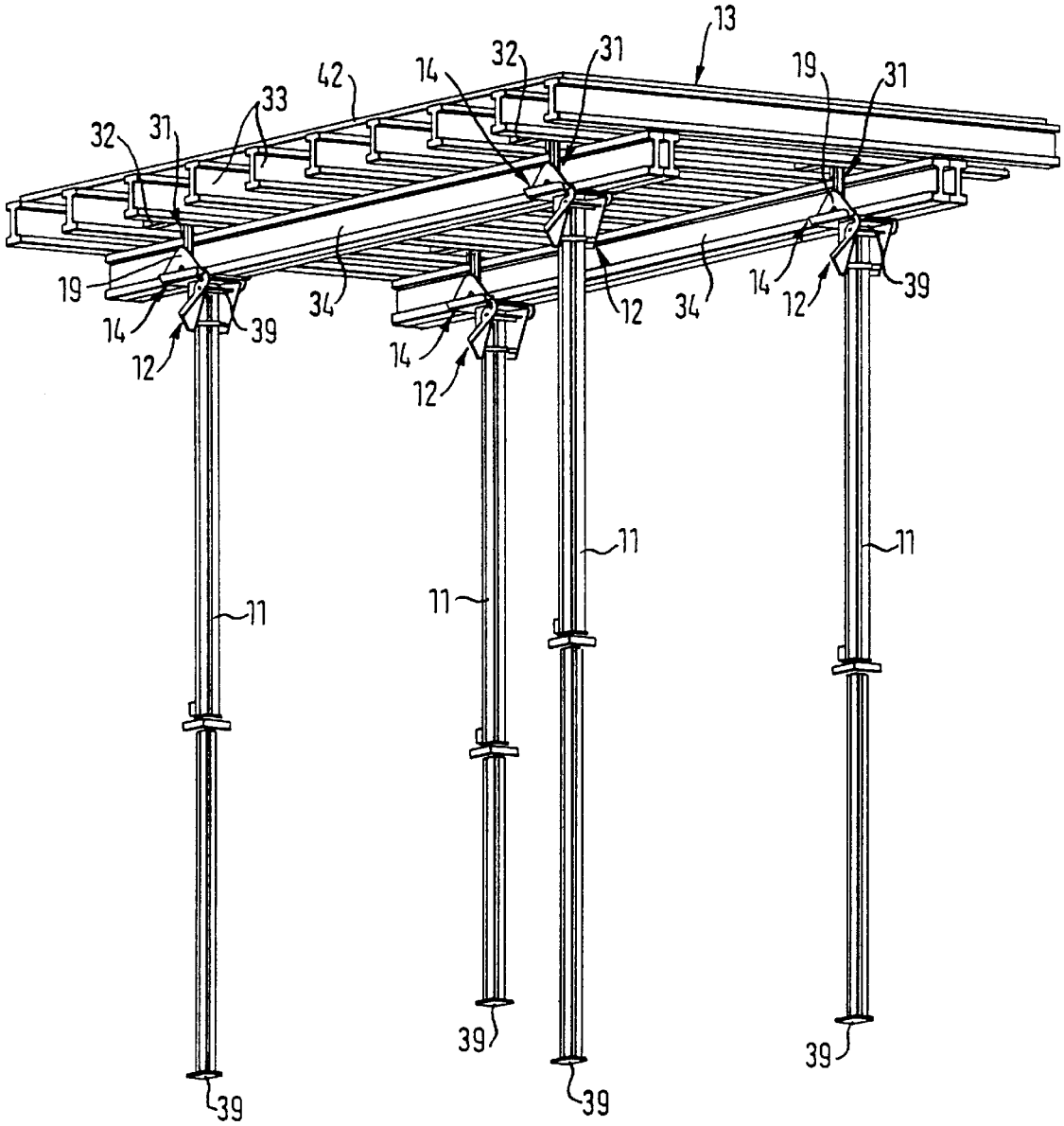

In accordance with FIG. 1 a formwork table 13 comprises a formwork skin 42, transverse beams 33 arranged at the underside of the formwork skin parallel to one another at the same spacing, and also truss beams 34 arranged beneath the transverse beams 33 perpendicular to the latter. The truss beams can also consist, in each case, of two closely arranged single beams. In this manner, a stable formwork table 13 is formed which is also suitable for receiving larger quantities of concrete.

The formwork table 13 is carried by four telescope supports 11 which stand at the bottom on a non-illustrated foundation and are terminated at the top by head plates 39 which extend perpendicular to the support axis. In their upper end region the supports 11 are fixedly connected to a transition support member 12. This is in turn releasably mounted on a counter-support member 14, which is so arranged and clamped between the transverse beams 33 and the truss beams 34, by means of carrier elements 31 and carrier beams 32, that it forms a fixed component of the formwork table 13.

Figure 2:
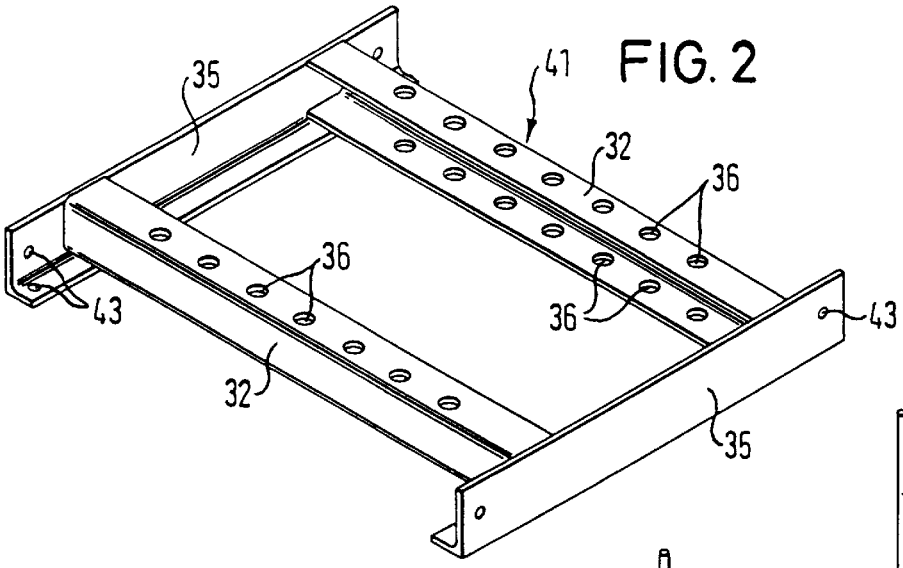
Figure 5:
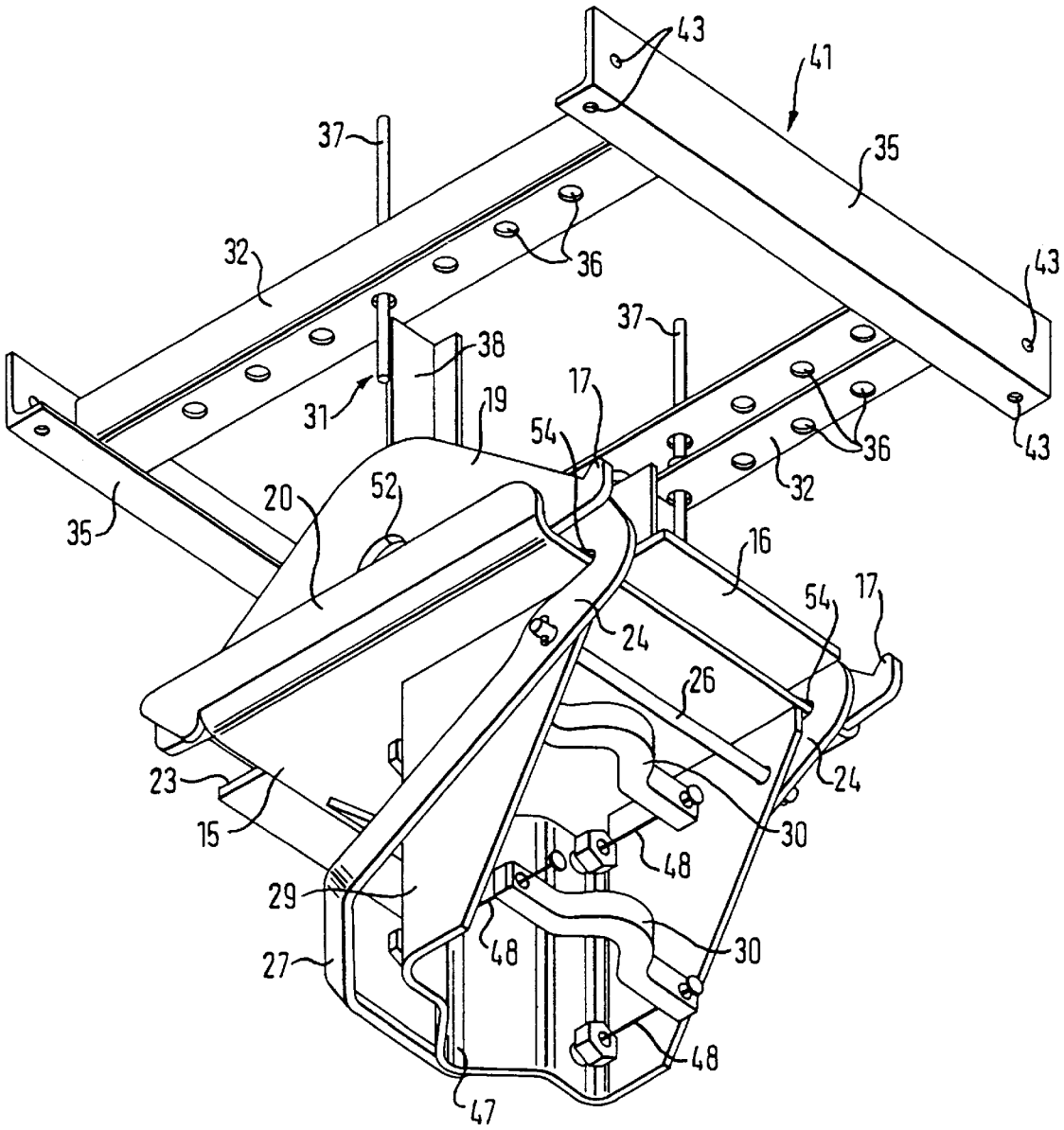
Figure 6:
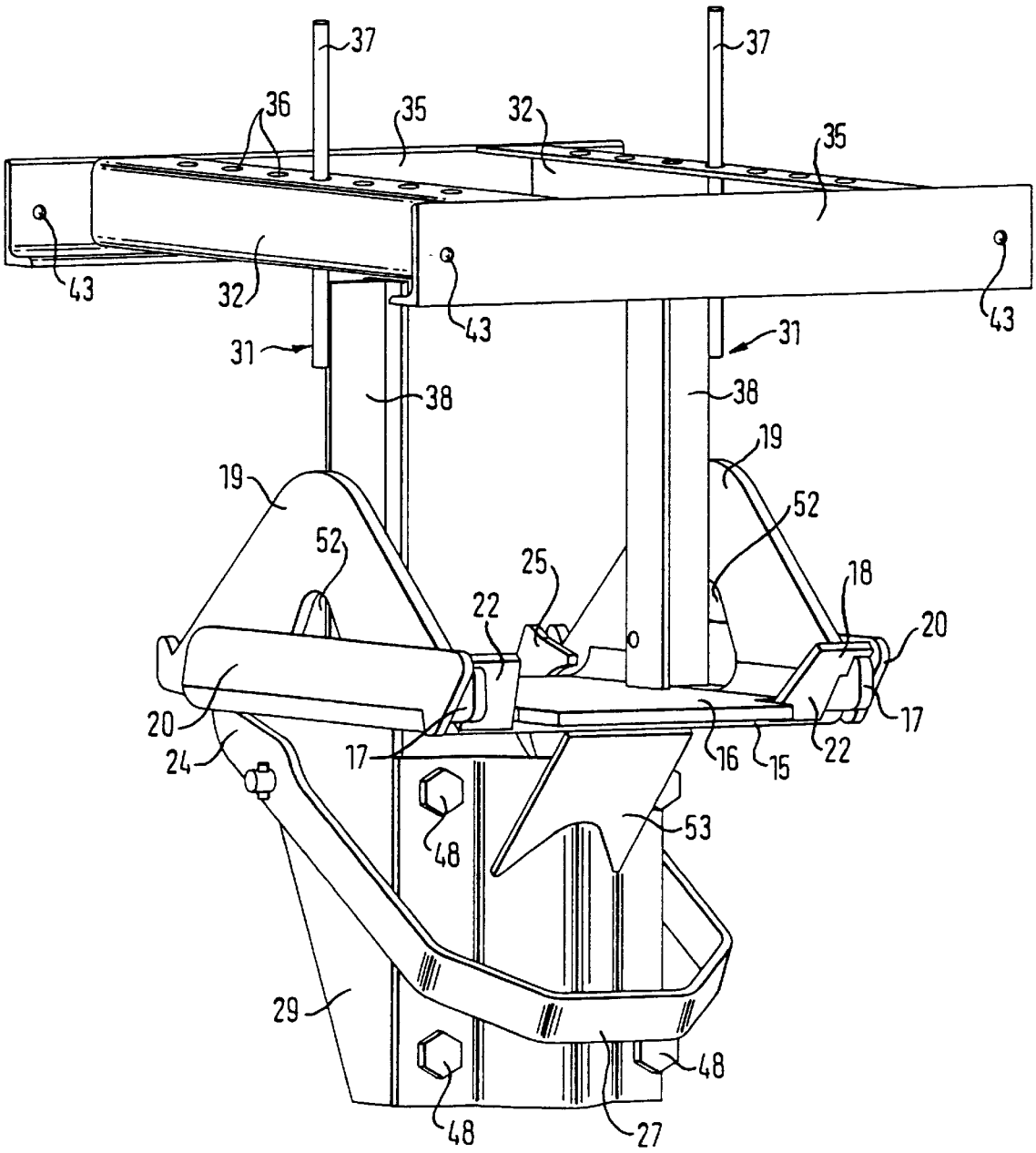

In accordance with FIGS. 2, 5 and 6, two carrier beams 32 are in each case secured parallel to one another to attachment brackets 35 extending perpendicular to them. The length of the carrier beams 32, i.e. the spacing of the two connection brackets 35 which complement the two carrier beams 33 into a carrier frame 41, is such that it corresponds to the spacing of two transverse beams 33, so that the carrier frame 41 of FIG. 7 just fits between two adjacent transverse beams 33 and can be secured to the latter above the truss beam 34 by means of bores 43 and non-shown screws. The connection brackets 35 are preferably formed in the illustrated manner by angle sections of which one limb can, in accordance with FIG. 7, lie on the lower spar 44 of the transverse beam 33, whereby a problem free and particularly stable mounting of the carrier beams 32 on the transverse beams 33 is ensured.

The carrier beams 32 are themselves formed as U-sections open towards one another and have a plurality of through-going attachment bores 36 at uniform intervals.

Figure 3:
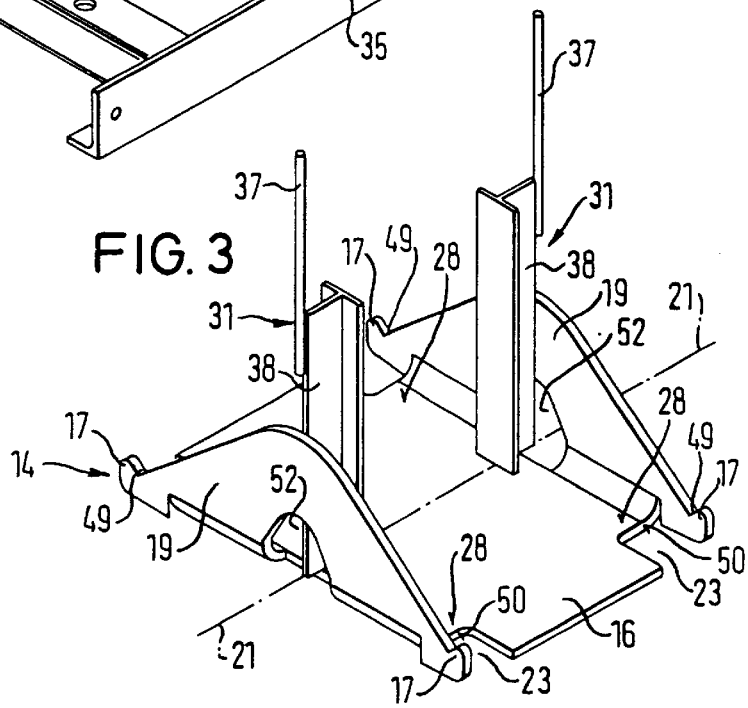
Figure 7:
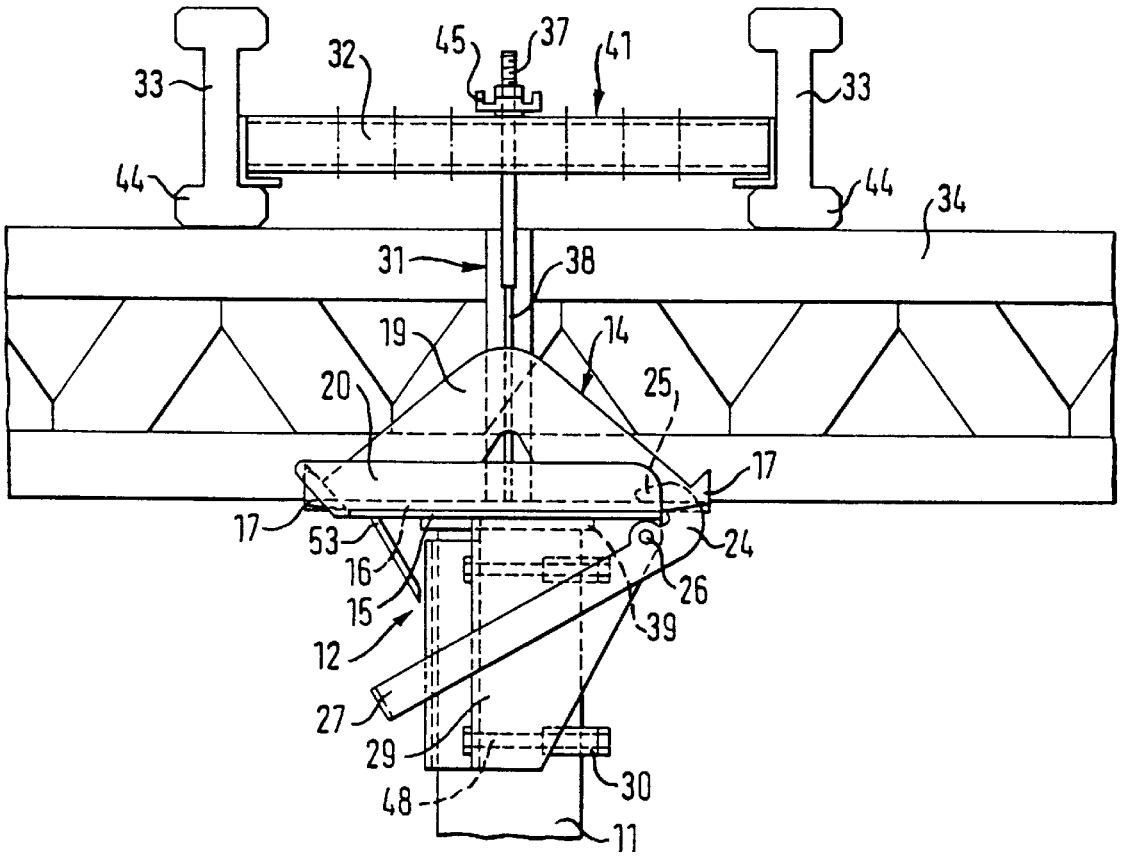

In FIG. 3 the counter-support member 14 is shown which is to be secured at the bottom to the carrier beams 32 of FIG. 2 and which—as one can also see from FIGS. 5 to 7—comprises a flat, horizontal counter-member support plate 16, two cheeks 19 which project vertically upwardly from its longitudinal sides, and vertically upwardly projecting carrier elements 31. The carrier elements 31 are formed by a lower T-section 38 and by respective vertical bolts 37 secured to their upper end region, which are introduced during the later assembly in accordance with FIGS. 5, 6 and 7 into a respective pair of bores 36 lying above one another of the carrier beams 32. Thereafter, in accordance with FIG. 7, clamping nuts 45 are screwed onto the bolts 37 which are provided with a thread at the top. The bolts 37 must therefore be provided with a thread, at least in their upper end region.

The cheeks 19 are formed in the manner which can be seen from FIGS. 3, 5 and 6 in the manner of a flat triangle with a rounded off upper tip and have substantially upwardly extending hooks 17 at their ends located in the region of the short sides of the support plate 16. The support plate 16 extends on both sides approximately up to the level of the hooks 17 and has right-angled cut-outs 23 directly alongside the hooks 17.

In accordance with FIGS. 3, 5 and 6, central and downwardly rounded cutouts 52 are provided in the side cheeks 19 of the support plate 16 of the counter-support member. In this manner, T-sections 38 can be better welded at the bottom.

The T-sections 38 are vertically arranged on the central transverse axis of the support plate 16, and indeed in such a way that the T-center web contacts the inner side of the cheeks 19 and is welded there. The bottom sections 38 stand up on the support plate 16 and are also preferably welded there. The transverse webs of the T-section 38 face one another and are parallel to one another. Their spacing is so selected that a double truss beam 34 just fits between them, as one can see from FIG. 1. As a result of the described arrangement, the counter-support member 14 in accordance with FIG. 1 can be pushed from below onto a double truss beam 34, with the vertical carrier elements 31 projecting upwardly between two cross beams 33, where a carrier frame 41 in accordance with FIGS. 2, 7 is secured, the bolts 37 passing through two of its pairs of bores 36. The spacing of the carrier beams 32 of the carrier frame 41 thus corresponds to the spacing of the bolts 37.

In accordance with FIG. 7, a clamping nut 45 is screwed from above onto the bolts 37. In this way the support plate 16 of the counter-support member is drawn from below against the double truss beam 34 and fixedly clamped against the latter. The transverse webs of the sections 38 thereby contact the truss beam 34 at the side. In this manner, the arrangement of the invention consisting of the carrier frame 41 and the counter-support member 14 also substantially contributes to the stability of the subframe of the formwork table 13. Decisive for the invention is, however, the fact that the counter-support member 14 practically only projects downwardly beyond the truss beam 34 by the thickness of the support plate 16 of the counter-support member. Since the thickness of the support plate 16 only amounts to approximately 8 mm, the downward projection beyond the formwork table 13 is thus practically negligible. For the lowest possible projection of parts of the counter-support member 14 downwardly beyond the truss beam 34 it is also important that the cheeks 19 including the hooks 17 only project upwardly from the support plate 16 and do not project downwardly.

Figure 4:
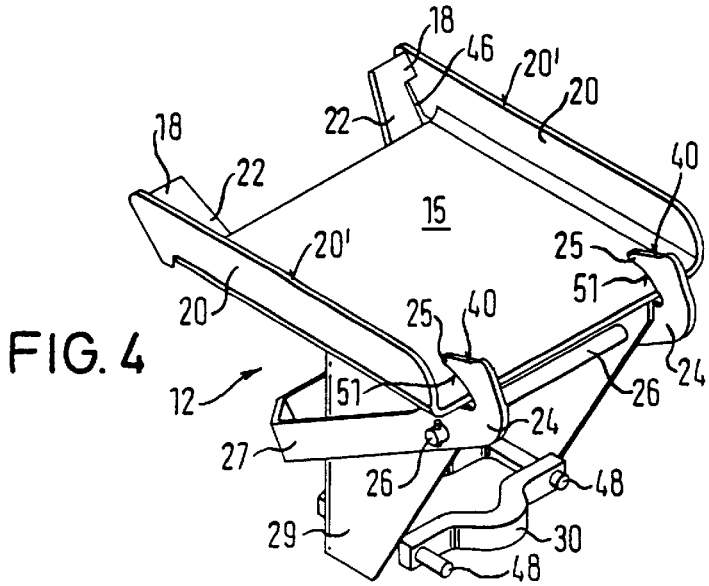

FIG. 4 shows the transition support member 12 of the invention which, in accordance with FIG. 1, is in each case firmly connected to the top end region of one support 11 and is so designed that it can be releasably but fixedly firmly connected with the counter-support member 14 of FIG. 3 from below.

The important component of the transition counter-member 14 is a horizontal flat support plate 15 of a thickness of approximately 6 mm which is made somewhat broader and shorter than the support plate 16 of the counter-support member in accordance with FIG. 3. Cheeks 20 are bent upwardly at the longitudinal sides of the support plate 15. The spacing of the cheeks 20 is so selected that when the transition support member 12 contacts the counter-support member 14, the cheeks 20 in accordance with FIGS. 5, 6 come into contact with the outer side of the triangular cheeks 19 of the counter-support member 14. The cheeks 20 are substantially lower than the cheeks 19 and have an upper edge 20' which extends parallel to the plane of the support plate 15.

At the rear end region of the cheeks 20 in FIG. 4, hook holders 18 project inwardly at a distance from the support plate 15 and are formed on obliquely upwardly bent brackets 22 of the support plate 15 which project at a narrow side of the plate.

Whereas a pair of hooks 17 is provided at the counter-support member 14 at each of the two ends of the support plate 16, and is designed with mirror symmetry to the other pair of hooks 17 with respect to the central transverse axis 21, the lower support plate 15 only has a pair of hook holders 18 at its one end. Between the obliquely upwardly bent brackets 22 and the associated cheeks 20 a slot 46 is provided beneath the hook holders 18 with the size of the slot being so dimensioned that a hook 17 can be introduced there.

In accordance with FIGS. 4 and 5, a holder 29 is mounted, preferably by welding, on the support plate 15 of the transition counter-member at the bottom and has a substantially U-shaped horizontal cross-section. At its closed side, the holder 29 has a vertically extending prismatic recess 47 of dimensions such that supports 11 of different cross-section (round, angular) and different dimensions can be received therein. For the fixation of the upper end regions of the supports 11 inserted there, two clamps 30 arranged above one another are also provided on the holder 29. The clamps can clamp the inserted upper end region of the support 11 against the recess 47 by bolts 48 which are only indicated (see also FIG. 6), so that the holder 29 practically forms a fixed component of the support 11. The clamps 30 are also selected in cross-section so that they fix supports of different cross-sectional shapes and sizes at the holder 29.

Two latch levers 24 are pivotally arranged on the holder 29 about a transverse axis 26 and each has a latch 25 above the pivot axis 26 which engages over the support plate 15 when the latch lever 24 is pivoted upwardly, as can be seen in FIG. 4.

The two latch levers 24 are firmly connected together by an actuating hoop 27 which extends around the holder 29 on the far side of the transverse axis 26. In this manner, the latch levers 24 are pivoted by the weight of the actuating hoop 27 into the position which can be seen from FIG. 4, providing the transition support member 12 is vertically arranged as is illustrated in FIG. 4.

At their upper side, the latches 25 have a latching ramp 40, the significance of which will be explained further below. It is important that the latching levers 24 can each be biased into the latching position shown in FIG. 4 by some form of resetting force, which can also be obtained with a resetting spring.

The dimensioning of the individual components of the transition support member 12 can be deduced from the following functional description.

After, for example, four carrier frames 41 have been secured to the lower side of the formwork table 13 in accordance with FIG. 1, together with the counter-support member 14 in the manner described above, and after a transition support member 12 in accordance with FIG. 4 has been secured by means of the clamps 30 to the top of each of the supports 11 that are used, the supports 1 1 can be installed on or dismantled from the formwork table 13 in the following manner:

First of all the formwork table 13 which is already provided with the carrier frames 41 and the counter-support members 14 is held at a specific level, for example by a crane, which is larger than the length of the supports 11 to be attached.

An operator can now in each case take a support 11 provided at the top of a transition support member 12 in his hand and guide the hook holders 18 over a pair of hooks 17, with the support 11 more or less inclined, and with the hooks 17 passing through the slots 46 (FIG. 4). As soon as the hooks 17 have been passed through the slots 46 the operator can relieve the relevant supports 11 somewhat, whereupon the hook holders 18 engage into the recess 49 (FIG. 3) located behind the hooks 17.

The support 11 and the counter-support member 14 are now already adjusted relative to one another in problem free manner. The operator pivots the supports 11 downwardly into the vertical position, with the latches 25 which are located in the position of FIG. 4 engaging into the cut-outs 23 of the support plate 16 of the counter-support member and with their latching ramps 40 abutting against the associated edge 50 (FIG. 3) of the support plate 16 at the base of the cut-outs 23. As a result of a suitable angle of the latching ramps 40 relative to the horizontal, a force is produced which presses the latch levers 24 away from the edge 50, so that the latch 25 is pivoted into its unlatched position and can finally slide past the edge 50 into the region above the support plate 16 of the counter-support member. As soon as this is the case, the weight force which is brought about by the actuating hoop 27 causes the latch 25 to pivot over upper latching counter surfaces 28 provided on the support plate 16 behind the cut-outs 23 and its lower counter surface 51 (FIG. 4) comes into engagement there. In this way, the support plates 15, 16 are fixedly clamped against one another. The latching engagement can be further enhanced if required by pulling on the actuating hoop 27. The end state of the latching of the support plates 15, 16 to one another can be seen from FIGS. 5, 6 and 7.

Depending on the direction in which the supports 11 are swung away from the upper support plate 16, the one or other pair of hooks 17 of FIG. 3 can be used for the engagement with the hook holders 18. In this manner, it is possible to attach the supports 11 to the counter-support member 14 in two positions rotated through 180° about their axes.

The separation of the supports 11 from the formwork table 13 then takes place in that the actuating hoop 27 (FIGS. 4, 5, 6, 7) is pushed upwardly, for example by means of a rod, whereby the latches 25 come free from the upper support plate 16. Thereafter, the support 11 can be pivoted about that pair of hooks 17 on which the lower support plate 15 is suspended. The latch levers 25 are pivoted downwardly during this and can thus come fully out of engagement with the upper support plate 16. The supports 11 can be pivoted up to and into the horizontal for transport but must be secured in a suitable manner to the formwork table 13 if they are to remain on the formwork table 13 during transport, so that no disengagement of the hook holders 18 occurs. However, should the supports 11 be transported separately from the formwork table 13, as is preferred, a simple disengagement of hook holders 18 from the hooks 17 can take place.

Thereafter, the formwork tables are available for transport with practically no projection of components downwardly. Because a projection of the counter-support members 14 downwardly has been dispensed with, a minimum stack height can thus be achieved during transport.

An important aspect of the invention lies in the fact that the head plate 39 of the supports 11, which can be seen in FIG. 7, admittedly makes a certain contribution to the mounting of the support 11 at the formwork table, in a manner stiff in bending, by contact at the lower side of the support plate 16 of the counter-support member. However, the important introduction of force into the supports 11, or from the supports 11, takes place via the attachment of the entire upper end region of the supports 11 in the holder 29 by means of the clamps 30.

The high bending stiffness of the arrangement of the supports 11 at the formwork table 13 is primarily achieved by the close contact of the support plates 15, 16. The form-fitted contact between the transition support member 12 and the counter-support member 14 brought about by the design in accordance with the invention is also of importance. The lateral form-fitted connection of the two support plates 15, 16 is achieved by the contacting of the cheeks 19, 20, while the form-fit in the longitudinal direction is achieved by the engagement of the hooks 17 on the hook holders 18 and the contact of the base of the groove 54 (FIG. 5) between the latch lever 24 and the latch 25 at the oppositely disposed edge 50 (FIG. 3) of the support plate 16.

The regions of the support plate 16 between the cut-outs 23 (FIG. 3) favor the lateral form-fitted connection of the two support members (12, 14) after the installation, because in this region a lateral contact arises against the bent brackets 22 and the latches 25.

Since the different types of supports 11 which are available can each be provided at their upper end with the same transition support member 12, a standardization arises independent of the supports, in such a manner that the most different types of supports can be used for the purpose of the invention.

On the one hand, the carrier frames 41 of the invention and the support counter-members 14 of the invention can ultimately be secured to any desired formwork table 13 or its subframe 33, 34. The invention thus ensures not only an easily installable and easily releasable and particularly stiff arrangement of the supports 11 at the formwork table 13, but rather also an extremely universal use for the most different types of supports 11 and formwork tables 13.

In order to achieve good bending stiffness it is advantageous when the support plates 15, 16 are made relatively large. Their dimensions can for example amount to ca. 15 cm×25 cm. The width of the support plates 15, 16 is ultimately predetermined by the width of the double truss beam 44, which is largely normed and standardized with the formwork techniques under discussion here.

In accordance with FIG. 6 obliquely extending sheet metal supports 53 can be arranged in accordance with the invention between the support plate 15 of the transition support member and the holder 29 and are welded to the support plate 15 and to the holder 29. In this way, the bending stiffness of the arrangement is further increased.

What is claimed is:

1. A formwork table arrangement comprising a formwork table which is substantially horizontally disposed when in a working position, a counter-support member secured to a lower side of the formwork table, a plurality of supports, a transition support member for and secured to a head end of each support, an engaging arrangement at the transition support member and at the counter-support member for pivotally engaging the transition support member with the counter-support member when the transition support member is tilted relative to the counter-support member, and a latching system for latching the transition support member to the counter-support member when the transition support member is pivotally moved into the working position.

2. Arrangement in accordance with claim 1 wherein the transition support member and the counter-support member each have a generally rectangular support plate which extends substantially parallel to the formwork table when the transition support member is in the working position, the support plates contacting one another in the working position and being pressed against one another by at least one of the engaging arrangement and the latching system.

3. Arrangement in accordance with claim 2 including first and second cheeks respectively projecting substantially perpendicularly upwardly from oppositely facing sides of the support plates.

4. Arrangement in accordance with claim 3 wherein the cheeks of the support plates extend away from the plates in the same direction and the cheeks projecting from one of the support plates embrace the cheeks projecting from the other one of the other support plates.

5. Arrangement in accordance with claim 3 wherein the first cheeks include hooks associated with one of the support plates at a bottom portion of the first cheeks, and wherein the second cheeks include hook holders associated with the other one of the support plates.

6. Arrangement in accordance with claim 2 wherein the engaging arrangement comprises hooks and hook holders at the transition support member and at the counter-support member, wherein the latching system includes a pivotally movable latch, and wherein the latch in its latching position extends about an edge defined by the oppositely disposed support plates.

7. Arrangement in accordance with claim 2 wherein the engaging arrangement comprises hooks and hook holders at the transition support member and at the counter-support member, and including a holder having a top welded to the support plates of the transition support member.

8. Arrangement in accordance with claim 2 wherein the engaging arrangement comprises cooperating hooks and hook holders at the transition support member and at the counter-support member; and wherein first and second, spaced-apart hooks are arranged alongside one another at at least one end of the associated support plate.

9. Arrangement in accordance with claim 8 including further hooks and hook holders provided symmetrically with respect to the hooks and hook holders relative to a substantially horizontal central transverse axis of the transition support member and the counter-support member.

10. Arrangement in accordance with claim 1 wherein the engaging arrangement comprises cooperating hooks and hook holders at the transition support member and at the counter-support member.

11. Arrangement in accordance with claim 10 wherein one of the counter-support member and the transition support member includes side cheeks, and wherein the hooks are provided at ends of the side cheeks.

12. Arrangement in accordance with claim 11 wherein the other one of the counter-support member and the transition support member includes lateral cheeks, and wherein the hook holders are provided at ends of the lateral cheeks.

13. Arrangement in accordance with claim 10 wherein the transition support member and the counter-support member each have a generally rectangular support plate which extends substantially parallel to the formwork table, and wherein the hook holders are formed by bent brackets formed by one of the support plates which define a space enabling passage of the hooks on the other support plate into engagement with the hook holders.

14. Arrangement in accordance with claim 13 wherein the other support plate includes cut-outs for receiving the bent brackets.

15. Arrangement in accordance with claim 1 including first and second sets of engaging arrangements which are symmetrically positioned so that the associated support can be mounted at first and second positions on the formwork table which are rotationally offset by 180°.

16. Arrangement in accordance with claim 1 wherein the latching system includes at least one latching lever which is pivotally connected to one of the support members and carries a latch which, when the support members are engaged with one another, and when the latch lever is in a latching position, acts on the other support member to firmly connect the support members together.

17. Arrangement in accordance with claim 16 wherein the latch is at one end of the latch lever and wherein another end of the latch lever merges into an actuating hoop.

18. Arrangement in accordance with claim 16 wherein the transition support member includes a holder, and wherein the latch lever is pivotally mounted on the holder.

19. Arrangement in accordance with claim 16 wherein an end of the latching lever opposite the latch includes an actuating hoop, and wherein the latch includes a latching ramp at an upper side thereof which is inclined so that upon pivoting the transition support member towards the counter-support member and on contact of the latching ramp with a counter-edge of the counter-support member, the latch lever is pivoted into its open position, whereby the latch can slide past the counter-edge and the weight of the actuating hoop subsequently automatically pivots the latching lever and the latch into the latching position.

20. Arrangement in accordance with claim 16 including means biasing the latching lever towards the latching position.

21. Arrangement in accordance with claim 1 wherein the transition support member includes a holder adapted to receive and fix the head end of the support.

22. Arrangement in accordance with claim 21 including a clamp for fixing the upper end of the support to the holder.

23. Arrangement in accordance with claim 1 including a substantially horizontally arranged carrier beam secured to transverse beams at the underside of the formwork table, and elongate carrier elements extending from the counter-support member upwardly and attached to the carrier beam.

24. Arrangement in accordance with claim 23 wherein the carrier elements include bolts the tops of which extend through bores in associated carrier beams.

25. Arrangement in accordance with claim 24 including truss beams arranged between the transverse beams and the support members, wherein lower ends of the carrier elements are formed by sections which contact sides of the truss beams and top sections of the carrier elements are spaced from the transverse beams, and nuts screwed onto the bolts clamping the support plate of the counter-support member from below against at least one truss beam.

26. Arrangement in accordance with claim 1 wherein the transition support member includes a support plate and the supports include head plates at their head ends which are oriented substantially perpendicular to the supports, and wherein the head plates contact the support plate of the transition support member from below.

27. Arrangement according to claim 1 wherein the transition support member is releasably secured to the associated support.

* * * * *